United States Patent [19]

Brady et al.

[11] 3,932,899

[45] Jan. 20, 1976

[54] COMBINATION SUPPORT FRAME AND SECURITY MEANS

[75] Inventors: G. Vincent Brady, Philadelphia; J. Les Campbell, Flourtown, both of Pa.

[73] Assignee: Kelsey-Hayes Company, Romulus, Mich.

[22] Filed: June 25, 1974

[21] Appl. No.: 483,030

Related U.S. Application Data

[63] Continuation of Ser. No. 244,820, April 17, 1972.

[52] U.S. Cl. ..... 4/3; 4/170; 4/252 R; 4/DIG. 7; 52/34; 52/106

[51] Int. Cl.[2] ..... A47K 4/00

[58] Field of Search ..... 4/3, 191, 192, 252 R, 2, 4/11, 170; 49/55; 312/228; 52/35, 34, 106; D23/49

[56] References Cited

UNITED STATES PATENTS

| | | | |
|---|---|---|---|
| 1,662,117 | 3/1928 | Kuhl | 49/55 |
| 1,771,945 | 7/1930 | Youngblood | 4/3 |
| 1,996,693 | 4/1935 | Wallace | 4/252 R |
| 2,076,950 | 4/1937 | Koch | 4/3 X |
| 2,860,348 | 11/1958 | McClenahan | 4/3 |
| 3,054,119 | 9/1962 | Manas et al. | 4/252 R |
| 3,129,437 | 4/1964 | McClenahan | 4/252 R |
| 3,701,172 | 10/1972 | McClenahan | 4/252 R |
| 3,722,152 | 3/1973 | Schlattery et al. | 52/35 |

OTHER PUBLICATIONS

*Salisbury Sales Co.*, Publication Copyright 1970, pp. 1–4.

*Salisbury Sales Co.*, Publication Copyright 1969, pp. 1–11.

*Primary Examiner*—Richard E. Aegerter
*Assistant Examiner*—Stuart S. Levy

[57] ABSTRACT

A combination support frame and security barrier for operatively supporting a plumbing facility in confronting relation with an opening in a poured concrete wall, partition, or the like, the assembly including a plurality of frame elements extending around the periphery of the opening and at least one security bar extending across the opening and supported at the opposite ends thereof by the frame elements to prevent unauthorized movement of a person, object, or the like through the opening.

8 Claims, 4 Drawing Figures

COMBINATION SUPPORT FRAME AND SECURITY MEANS

This is a continuation of application Ser. No. 244,820, filed Apr. 17, 1972.

SUMMARY OF THE INVENTION

Generally speaking, the present invention is directed toward a support frame for operatively supporting a plumbing facility, such as a lavatory, water closet or the like, upon a poured concrete wall, partition, etc. More particularly, the present invention is directed toward a new and improved support frame of the above described type which is particularly adapted for operative association with poured concrete walls having openings therein through which plumbing conduits, such as water supply lines, drain lines and the like, are disposed for communication with an associated plumbing facility, as might typically be utilized in an institution, such as a penal institution. Toward this end, the present invention incorporates a novel arrangement of frame elements which are adapted to be mounted within the concrete wall around the periphery of the opening and which are operatively associated with a plurality of security bars that extend across the opening and are supported at the opposite ends thereof by the frame elements to prevent unauthorized movement of an object, person or the like through the opening.

It is accordingly a general object of the present invention to provide a new and improved combination support frame and security barrier for operatively supporting a plumbing facility on a wall, partition, etc. and in confronting relation to an opening in the wall through which plumbing supply and drain lines are disposed.

It is a more particular object of the present invention to provide an assembly of the above described type which utilizes a plurality of security bars extending across the opening and which are cast into the associated concrete wall along with the support frame so as to prevent unauthorized passage of a person, object or the like through the opening.

It is still another object of the present invention to provide a new and improved combination support frame and security barrier, as above described, which includes means for expanding the support frame thereof into contiguous engagement with the periphery of the opening in the event the concrete in the associated wall shrinks away from the frame during the curing thereof.

It is still another object of the present invention to provide a new and improved combination support frame and security barrier of the above described type which is of a relatively simple design, is economical to manufacture and easy to install.

Other objects and advantages of the present invention will become apparent from the following detailed description taken in conjunction with the accompanying drawing.

BRIEF DESCRIPTION OF THE DRAWING

FIG. 1 is an elevated perspective view of a typical plumbing facility which is adapted to be operatively supported upon a wall, partition or the like by means of the support frame and security barrier of the present invention;

FIG. 2 is a front elevational view of the combination support frame and security barrier of the present invention, as shown in operative association with a typical poured concrete wall or the like;

FIG. 3 is a longitudinal cross-sectional view of the support frame shown in FIG. 2, as shown in operative association with the plumbing facility depicted in FIG. 1, and FIG. 4 is an enlarged fragmentary cross-sectional view of one of the security bars incorporated in the present invention.

DETAILED DESCRIPTION OF THE PREFERRED EMBODIMENTS

Figures 1, 2, 3, 4:
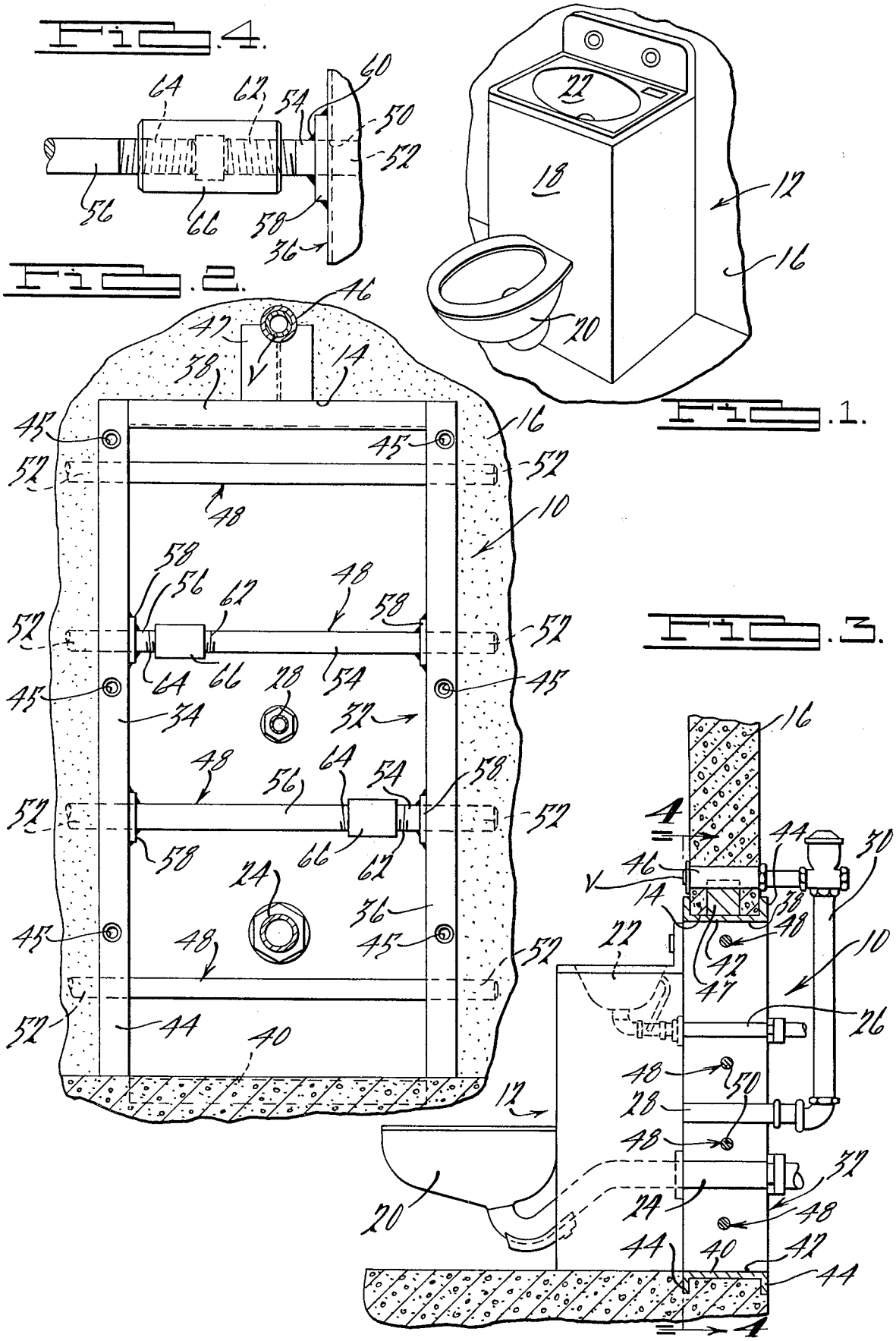

Referring now in detail to the drawing and in particular to FIGS. 1 and 2 thereof, a combination support frame and security barrier assembly, generally designated by the numeral 10, is shown in operative association with a conventional plumbing facility 12 which is adapted to be mounted in confronting relation with an opening 14 formed in an associated wall, partition or the like 16. The facility 12 may be of any suitable construction and is representatively illustrated herein as comprising a generally parallelepiped shaped housing or enclosure 18 adapted to operatively support a conventional water closet or the like 20 on the forward side thereof and have a conventional lavatory of the like 22 mounted adjacent the upper end thereof. As is well known in the art, the water closet 20 and lavatory 22 may be provided with conventional drain conduits 24, 26 respectively, and with suitable fresh water supply conduits 24, 26, 28 and 30, which conduits 24–30 originate within or on the far side of the associated wall 16 and are adapted to extend through the opening 14 and be connected to the facility 12. As will be appreciated by those skilled in the art, the ends of the conduits 24, 26, 28 and 30 opposite those which are connected to the facility 12, are communicable with main supply and drain conduits (not shown) which might typically supply a plurality of facilities 12. As will hereinafter be described in detail, the assembly 10 is adapted to serve the two-fold prupose of operatively supporting the facility 12 upon or adjacent the wall 16 and also act as a security barrier to prevent the movement or passage of objects, persons or the like through the opening 14 in the wall 16.

Referring now in detail to the construction of the assembly 10, as best seen in FIGS. 2 and 3, said assembly 10 comprises a generally rectangular shaped frame 32 consisting of a pair of spaced parallel side frame elements 34 and 36 and a pair of vertically spaced, parallel top and bottom frame elements 38 and 40. The frame elements 34, 36, 38 and 40 are arranged in end-to-end abutting relationship with the opposite ends thereof being fixedly secured to the abutting ends of the adjacent elements, as by welding or the like. It will be appreciated, of course, that the various dimensions and orientation of the frame elements 34–40 will be different, depending upon the configuration of the opening 14 and the associated plumbing facility 12, and that the respective sizes of the frame elements 34, 36, 38 and 40 are determined by the dimensions of the associated opening 14.

As best seen in FIG. 3, each of the frame elements 34, 36, 38 and 40 is of uniform cross-sectional shape and comprises an intermediate web portion 42 which terminates at the opposite longitudinal edges thereof in integral outwardly projecting spaced parallel flange portions 44. In accordance with the present invention, the frame 32 is intended to be cast into the associated concrete wall, partition or the like 16 during the fabrication thereof, whereby to delineate the periphery of the opening 14 and be permanently fixedly secured within the wall 16. The dimensions of the wall 16 are shown as being approximately equal to the lateral distance between the flange portions 44 of the frame elements 34, 36, 38 and 40, however, it will be appreciated by those skilled in the art that the thickness of the wall 16 may be either greater or smaller than that shown in FIG. 3, i.e. smaller or larger than the dimension of the frame elements 34, 36, 38 and 40.

As best seen in FIG. 2, the flange portions 44 of the frame elements 34, 36, 38 and 40 confronting the side of the wall 16 upon which the plumbing facility 12 is to be mounted is formed with a plurality of apertures 45 that are cooperable with suitable fastening means, such as screws, bolts or the like (not shown), in operatively securing the facility 12 to the assembly 10.

It is noted that for certain applications, the support frame 32 may also be adapted to support a flush valve, representatively designated in the drawings by the letter V, which may be of any suitable construction and adapted to be manually actuated to effect a flushing of the associated water closet 20. Such support means on the frame 32 is preferably in the form of a generally cylindrical sleeve-like element 46 which is fixedly secured to the upper or top frame element 38 by means of a suitable support bracket or the like 47 at a position intermediate the side frame elements 32 and 34. As shown in FIG. 3, the support sleeve 46 is adapted to be cast integrally with the frame 32 directly within the concrete wall 16 and is of sufficient length to extend through the wall 16 to permit the flush valve V to project therethrough.

In accordance with one of the features of the present invention, the assembly 10 is provided with a plurality of security elements or bars 48 which are arranged in spaced parallelism in a manner best shown in FIG. 2. The security bars 48 are intended to extend across the opening 14 and thereby prevent the unauthorized movement of objects, persons and the like through the opening 14 at such time as the facility 12 is dismounted from the assembly 10. As shown in FIG. 2, the security bars 48 are somewhat greater in length than the lateral width of the opening 14 and as such, are intended to extend through suitable openings 50 in the web portions 42 of the side frame elements 34, 36 and be imbedded or cast within the concrete wall, partition or the like 16. As shown, the terminal ends of the bars 48, herein generally designated by the numeral 52, preferably project outwardly beyond the side frame elements 34, 36 a sufficient distance so that they will cooperate with the flange portions 44 of the frame elements 34, 36, 38 and 40 in reinforcing the assemblage and permanently anchoring the same within the associated wall 16. It will be noted that the security bars 48 are spaced sufficiently apart to permit the drain conduits 24, 26 and supply conduits 28, 30 to extend through the assembly 10 and thereby connect the facility 12 with the associated drain and supply lines located within or on the opposite side of the wall 16 from the facility 12. It will be also noted that the security bars 48 may extend vertically between the top frame element 38 and bottom frame element 40, as opposed to extending generally horizontally between the side frame elements 34, 36, provided, of course, that said bars 48 are spaced sufficiently close together to prevent the aforementioned unauthorized passage of objects, persons, etc. through the opening 14, yet are spaced sufficiently far apart to enable the plumbing conduits to be connected to the facility 12.

In accordance with another feature of the present invention, at least one of the security bars 48 may be provided with means for effecting expansion of the frame 32 after the same has been operatively mounted or cast within the associated wall 16, whereby to assure that the frame 32 is contiguously engaged with the periphery of the opening 14. It will be appreciated by those skilled in the art that during the pouring or casting of the concrete constituting the wall 16, the concrete is in contiguous engagement with the frame 32; however, as the concrete begins to cure, it may have a tendency to shrink away from the surfaces of the frame 32, and it is the purpose of the aforementioned expansion means on at least one of the security bars 48 to effect expansion of the frame 32 back into contiguous engagement with the periphery of the opening 14 in the event such shrinking of the concrete occurs. While various types of expansion means could be utilized, the present invention preferably effects such expansion by providing one or more of the security bars 48 in two coaxially arranged bar sections 54 and 56 which have the outer end thereof secured, as by reinforcing plates or the like 58 and welding 60 to the adjacent side frame elements 34, 36. The confronting ends of the bar sections 54, 56 are provided with threaded end portions 62, 64 which have the respective thread forms of opposite hand. The confronting threaded end portions 62, 64 are adapted to be threadably received within a suitable internally threaded collar or sleeve member 66, the internal threads of which cooperate with the threads on the end portion 62, 64 in a manner such that rotation of the collar 66 effects opposed movement of the bar sections after the assembly 10 has been operatively mounted within the associated wall 16. Thus, assuming that any shrinkage occurs in the concrete during curing thereof, whereby the periphery of the opening 14 is spaced away from the associated frame 32, the collar 66 may be properly rotated to effect opposed movement of the associated bar sections 54, 56. When this occurs, the side frame elements 34, 36 will be biased outwardly to position wherein the outer surfaces thereof are again contiguously engaged with the periphery of the opening 14.

It will be seen from the foregoing that the present invention provides a novel combination support frame and security barrier assembly which is intended to find particularly useful operation in operatively supporting plumbing facilities in penal and similar type institutions. In such application, it is not unusual to have persons unauthorizedly remove a plumbing facility, such as the facility 12, from the associated wall and attempt to escape through the opening behind the facility 12 through which the plumbing conduits extend. By virtue of the provision of the security bars 48 extending across the opening and being rigidly secured or anchored therein by means of the support frame 32, such access or escape through the opening is positively prevented. It will also be noted that the assembly 10 of the present invention is of a relatively simple design so that it may be economically manufactured and easily installed where it will have a long, effective operational life.

While it will be apparent that the preferred embodiment illustrated herein is well calculated to fulfill the objects above stated, it will be appreciated that the present invention is susceptible to modification, variation and change without departing from the scope of the invention.

What is claimed is:

1. In combination with a plumbing facility adapted to be mounted in confronting relation to an access opening in a structure fabricated of concrete, within which water supply and drain conduits for the facility are located, a frame cast into said concrete within the opening and comprising a plurality of frame elements arranged in end-to-end abutting relation and located around the periphery of said opening and a plurality of spaced security bars extending across said opening and supported at opposite ends thereof by said frame elements with some of said ends extending beyond said frame elements into said concrete for preventing unauthorized passage from one side of said structure to the opposite side thereof through said opening, at least one of said security bars including means for expanding said frame to assure contiguous engagement thereof with the periphery of said opening, said security bar comprising first and second end sections having confronting terminal end portions threaded with opposite hand thread forms, and wherein said expansion means comprises a sleeve-like member having an internally threaded bore adapted for threadable engagement with said terminal end portions, whereby preselected rotational movement of said sleeve element will effect opposed movement of said bar sections to cause the associated frame to expand into contiguous engagement with the periphery of said opening, and means attached to said frame and protruding therefrom adapted to support part of said plumbing facility.

2. The combination as set forth in claim 1 wherein said plumbing facility comprises a lavatory and water closet disposed in confronting relationship to said opening.

3. The combination of claim 2 wherein the lavatory and water closet are mounted on a cabinet.

4. The combination as set forth in claim 1 wherein said frame elements are arranged in a generally rectangular configuration, wherein said plurality of security bars are arranged in spaced parallel relation, and which includes a plurality of mounting means on said frame elements adapted to mount and support said plumbing facility.

5. The combination as set forth in claim 1 wherein the security bars are arranged horizontally in spaced parallel relation transversely across said frame.

6. The combination as set forth in claim 1 wherein the security bars are arranged vertically in spaced parallel relation transversely across said frame.

7. The combination as set forth in claim 1 wherein said means attached to said frame and protruding therefrom comprises a support for a flush valve of said plumbing facility.

8. The combination as set forth in claim 7 wherein said support for a flush valve extends from one side of said structure to the opposite side thereof.

* * * * *